United States Patent [19]

Smith

[11] 4,088,091

[45] May 9, 1978

[54] FIN ASSEMBLY FOR POWER BOATS

[76] Inventor: Richard J. Smith, 4072 Santa Lucia, Orange, Calif. 92665

[21] Appl. No.: 738,543

[22] Filed: Nov. 3, 1976

[51] Int. Cl.[2] ..... B63H 5/16

[52] U.S. Cl. ..... 115/39; 114/162

[58] Field of Search ..... 114/162, 62, 288, 290; 115/39, 42; 9/2 R, 2 C, 2 S

[56] References Cited

U.S. PATENT DOCUMENTS

| | | | |
|---|---|---|---|
| 961,750 | 6/1910 | Branth | 115/42 X |
| 985,187 | 2/1911 | Lindgren | 115/39 |
| 1,007,583 | 10/1911 | Loetzer | 115/39 |
| 1,108,340 | 8/1914 | Criqui | 115/39 |
| 3,823,684 | 7/1974 | Baggs | 115/39 |

*Primary Examiner*—Barry L. Kelmachter
*Attorney, Agent, or Firm*—Raymond L. Madsen

[57] ABSTRACT

There is disclosed a fin structure for mounting in an opening in the hull of a power boat having an elongated rectangular panel connected between the base edges of a pair of elongated fins, each fin having a base edge, a leading edge and a trailing edge, being joined to the elongated rectangular panel to locate the pair of fins in substantially parallel alignment and to form a channel adapted to receive a propeller and propeller shaft therein with the propeller in proximity of the trailing edges, the trailing edge of each fin projecting from one end of the base edge beyond the outer most extremeties of the propeller received in the channel, the leading edge extending from the end of the trailing edge and sloping forward along the hull to the other end of the base edge in a manner to be more distant from the rectangular panel at any point than the propeller shaft received in the channel such that the propeller and propeller shaft are entirely contained within the channel formed between the pair of fins to protect the propeller and propeller shaft from damage when the fin structure is mounted in the opening in the hull such that the fins extend from the hull, the leading edges forming skids and offering a minimum of resistance to movement through water as well as adding stability to the hull and increasing the efficiency of the propeller. A rudder may be attached to each trailing edge of the fins and a "V-drive" unit may be added to reverse the longitudinal direction of the transmission power-train between the propeller shaft and an engine inside the hull.

7 Claims, 5 Drawing Figures

FIN ASSEMBLY FOR POWER BOATS

The present invention relates to power boats and more particularly to the power train of power boats with through-the-hull propeller shafts.

In the field of inboard power boats, it has been the general practice to employ a power drive train utilizing through-the-hull propeller shafts to obtain greater propeller efficiency and a resulting higher speed. Although such a configuration has served the purpose, it has not proven entirely satisfactory under all conditions of service for the reasons that considerable difficulty has been experienced in protecting the propeller and propeller shaft from damage from objects in the water, from striking bottom and while being loaded and unloaded from trailers. Although some attempt has been made to enclose the propeller shaft exterior to the hull in a supporting housing and to surround the propeller in protective shrouds and rings, they have resulted in lower efficiency and lower speeds. The present invention overcomes these difficulties.

Those concerned with the development of inboard power boats have long recognized the need for a better stearing capability at slow speeds and, especially while traveling in reverse. The present invention fulfills this need.

One of the most critical problems confronting designers of inboard boats has been providing for protection from damage to the propeller and propeller shaft while loading and launching from conventional boat trailers. This problem is overcome by the present invention.

In the field of inboard-outboard boats, it has been the general practice to employ a bellows connection through the stern through which the power train from the engine passes to a first tilting right angle bend and then along the stern to a second fixed right angle bend to the propeller. Although such a structure has served the purpose, it has not proven entirely satisfactory under all conditions of service for the reasons that considerable difficulty has been experienced in preventing leaks in the bellows through the stern and in operatively maintaining the two right angle transmission units. Furthermore, the physical size of the right angle transmission unit adjacent the propeller reduces the efficiency of the propeller.

Those concerned with the development of inboard-outboard boats have long recognized the need for a structure which will enable the designer to obtain the efficiencies and speeds of an inboard boat while at the same time providing the protection to the propeller and propeller shaft afforded by the tilting drive train of the inboard-outboard boat. The present invention fulfills this need.

The general purpose of this invention is to provide a power boat having a through-the-hull propeller shaft which embraces all the advantages of inboard-type power boats and possesses none of the aforedescribed disadvantages. To attain this, the present invention contemplates a unique finned channel structure for receiving therein the propeller and propeller shaft whereby damage to the propeller and propeller shaft and poor performance and efficiency are avoided.

The present invention provides the same protection to the transmission power train that the inboard-outboard power boat provides, but attains this protection without resort to right angle bends in the power train and the increased cost and maintenance associated therewith. The fin structure does not materially degrade the performance of the inboard while providing protection to the propeller and drive train afforded by the inboard-outboard boat transmission system.

An object of the present invention is the provision of a finned channel structure to protect the propeller and propeller shaft of an inboard boat.

Another object of the invention is to provide a power boat having the performance characteristics of an inboard boat but possessing the protective characteristics to the drive train afforded by an inboard-outboard boat.

A further object of the invention is the provision of a rudder system which provides greater stability at slow speeds and better stearing capability in reverse for inboard boats.

Still another object is to provide a propeller shaft and propeller housing assembly for inboard-outboard boats which eliminates the through-the-stern bellows and dual right angle power train bends.

Yet another object of the present invention is the provision of a protective channel structure for a through-the-hull propeller and propeller shaft to prevent damage from floating and under water objects, grounding or striking the bottom, and from trailer damage while transporting, loading or launching.

Other objects and many of the attendant advantages of this invention will be readily appreciated as the same becomes better understood by reference to the following detailed description when considered in connection with the accompanying drawings in which like reference numerals designate like parts throughout the figures thereof and wherein.

Figure 1:
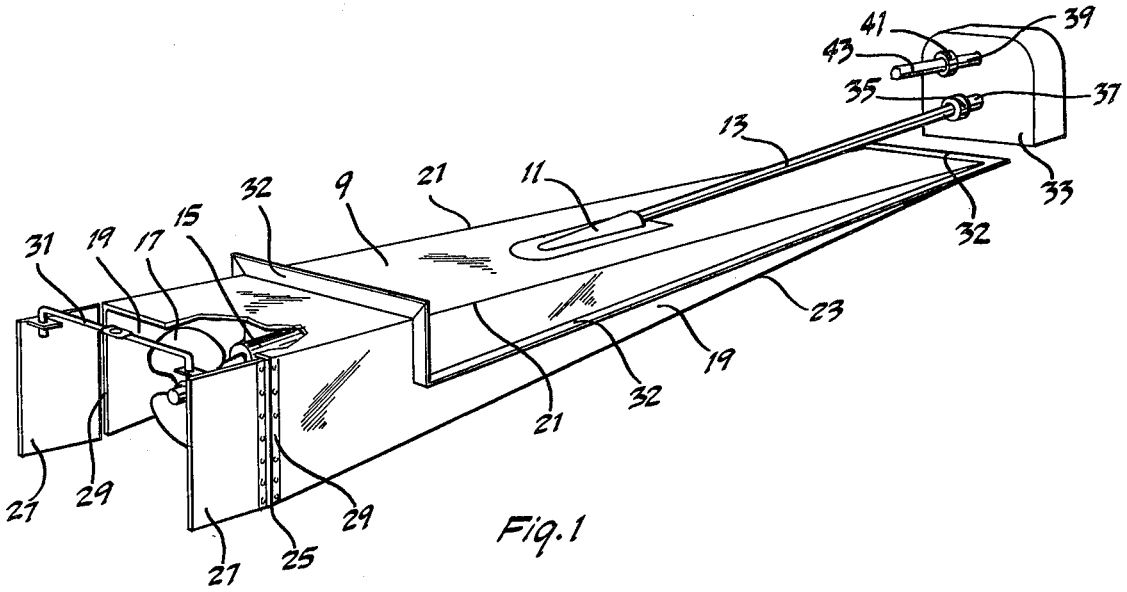
FIG. 1 illustrates a perspective view of a preferred embodiment of the present invention.

Referring now to the drawings wherein like reference characters designate like or corresponding parts throughout the several views, there is shown in FIG. 1 (which illustrates a preferred embodiment) a base panel 9 having an opening therein in which a through-the-hull propeller shaft bushing 11 is located and through which a propeller shaft 13 passes supported by a shaft support bushing 15. A propeller 17 is attached to the end of the shaft and is located in a channel formed between a pair of elongated triangular sides or fins 19 each of which have a base edge 21 attached to an oppositely disposed edge of longest dimension of rectangular panel 9. A trailing edge 25 projects from base edge 21 and is connected by a sloping leading edge 23 to the other end of base edge 21. Trailing edge 25 is attached to a rudder 27 by a hinge 29, thus forming a pair of rudders. The pair of rudders is further connected together to be operated in unison by a stearing mechanism 31.

A mounting flange 32 for connecting the fin assembly into an opening in the hull of a boat is fastened along triangular sides 19 from the junction of base edge 21 and leading edge 23 to a point in proximity of trailing edge 25 and from this point on each of sides 19 to base edge 21 and between base edges 21 across rectangular panel 9 and further extending along the edge of rectangular panel 9 between the juncture of base edge 21 and leading edge 23 of each of sides 19.

Propeller shaft 13 is connected to a power train reversing unit or gear box 33 by a coupling unit 35, which in turn is coupled to a shaft 37 of power train reversing unit 33. A shaft 39 of power train reversing unit 33 is coupled to an engine drive shaft 43 by a coupling unit 41.

It should be noted that coupling units 35 and 41 may be universal joints as required. It should also be noted that power train reversing unit 33 may be a "V-drive" unit well-known in the boating industry for reversing the longitudinal direction of power train systems.

Figure 2:
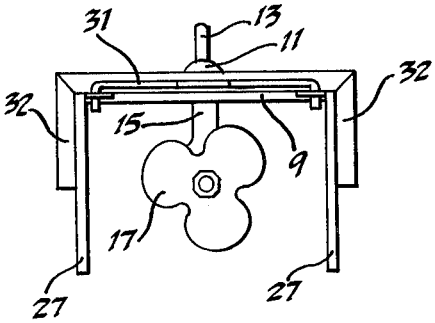
FIG. 2 illustrates an end view of the fin structure of FIG. 1.

Turning now to FIG. 2 there is illustrated an end view of the fin assembly illustrated in FIG. 1. Rudders 27 are attached to trailing edges 29 (not illustrated) of triangular sides or fins 19 on either side of propeller 17. Support bushing 15 is directly behind propeller 17 and is attached to rectangular panel 9. Stearing mechanism 31 connects rudders 27 together to act in unison. Although a rod connection is illustrated, other structures and devices well known in the boating industry may be used for operating the rudders. A portion of Flange 32 for connecting the fin assembly in an opening in the stern of a boat is visible.

Figure 3:
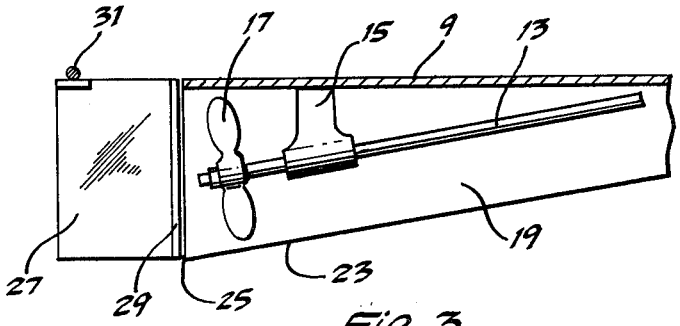
FIG. 3 shows a cut-away side view of the fin structure illustrated in FIG. 1.

Turning now to FIG. 3, one of the triangular fins 19 is cut away to reveal a section of propeller shaft 13 passing through bushing support 15 and fastened to propeller 17. Trailing edge 25 of triangular fin or side 19 has a dimension which exceeds the most distant extremeties of propeller 17 from rectangular panel 9 which in turn is attached to the hull of a boat. Leading edge 23 is at all points maintained a distance from rectangular panel 9 greater than the distance of the propeller shaft from rectangular panel 9. Trailing edge 25 is connected to rudder 27 by hinge 29 and a stearing mechanism 31 attached thereto.

Figure 4:
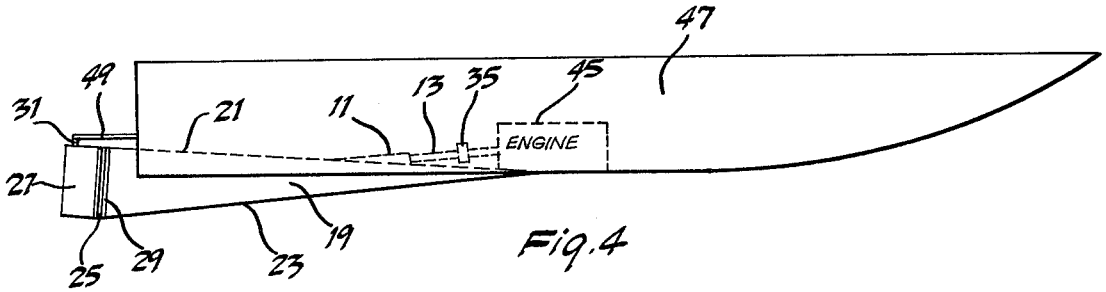
FIG. 4 illustrates a side view of the preferred embodiment of the invention mounted on the hull of a boat.

FIG. 4 illustrates a side view of a hull of a boat 47 having an opening into which the fin or channel assembly illustrated in FIG. 1 is inserted and partially recessed as shown by dashed base line 21. Triangular fin 19 partially extends from the hull beyond the stern and the keel and obscures from view propeller shaft 13, propeller support bushing 15 and propeller 17. Trailing edge 25 projects from the hull of the boat at the stern thereof a distance greater than the most remote extremity of the propeller from the hull. Leading edge 23 slopes from the end of trailing edge 25 toward hull 47 always maintaining a distance from the hull at any point greater than the distance of the propeller shaft from the hull. Hull bushing 11 within the boat hull (shown in dashed lines) has propeller shaft 13 passing therethrough to coupling 35 which in turn is connected to the shaft of engine 45, all of which are within hull 47 and shown by dashed lines. The extension of fins 19 beyond the stern and the keel of the hull increases the stability of the boat.

It should be noted in FIG. 4 that instead of using powertrain reversing unit 33, propeller shaft 13 is longitudinally coupled directly in line with the drive shaft of engine 45 eliminating the power-train reversing unit. This configuration is typical of a normal installation in an inboard power boat. Also, it should be noted that it is contemplated within the invention that the fin or channel assembly may not be recessed within the hull but may be mounted to substantially be external to the hull.

Triangular fins 19 and panel may be made of steel or a material with structural strength to easily withstand the forces and pressures of objects which may strike the assembly or the weight or pressure of the boat encountered while on a trailer or while grounded on the bottom or shoreline of a water environment.

Figure 5:
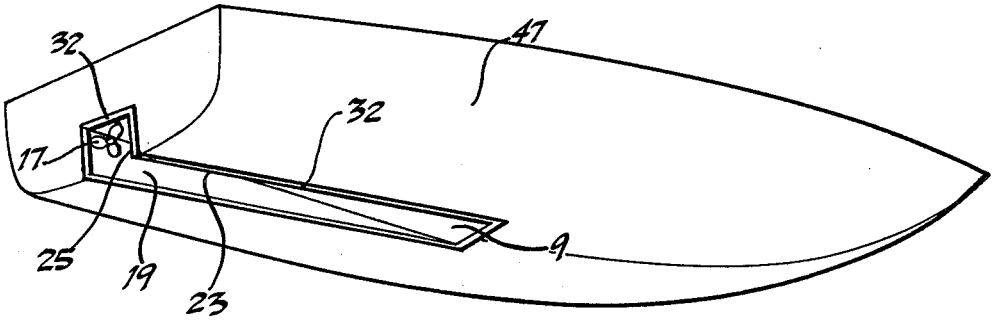
FIG. 5 shows a perspective view of the stern and keel of a power boat with the preferred embodiment of the invention completely recessed within an opening in the hull.

FIG. 5 illustrates the fin or channel assembly completely recessed within an opening in the stern and keel of a power boat. Fins 19 do not extend beyond the hull and mounting flange 32 is fastened along leading edge 23 and trailing edge 25 of each fin 19 and along each edge of smallest dimension of rectangular panel 9. The rudder assembly is omitted from FIG. 5 in order to view propeller 17 within the channel formed between fins 19.

Operationally the invention can best be described by first referring to FIG. 4. Triangular fins 19 with leading edge 23 extending beyond the hull provide a skid-like appearance to deflect or prevent underwater or floating objects from striking propeller 17 or propeller shaft 13. Triangular fins 19 are thin walled and offer very little resistance to motion through the water, thereby not impairing the performance of the boat. Engine 45 is shown in dashed lines mounted in the position of the well-known inboard installation with the drive shaft extending forward in hull 47.

In FIG. 1 the drive-train direction is reversed by drive-train reversing unit 33 to couple engine drive shaft 43 to propeller shaft 13. Therefore, a hull designed for an inboard-outboard installation can be readily converted to a through-the-hull propeller shaft installation similar to an inboard boat shown in FIG. 4 with the same attendant performance advantages of an inboard boat. However, the disadvantages of an inboard installation such as damage to the propeller and propeller shaft are eliminated by the present invention due to the protective channel and skid-like leading edges provided by fins 19 located on either side of the propeller shaft and propeller which prevent objects of dimension larger than the spacing between the fins from striking the propeller and propeller shaft. Further, dual rudders mounted on the trailing edges of fins 19 offer greater guiding surface area which not only produces a better stearing capability in reverse but also provides more sensitive stearing performance at low speeds.

Although a simple stearing mechanism 31 is illustrated connecting the two rudders together to act in unison, it should be noted that other stearing mechanisms may be employed which are well-known to the field of power boats.

It should be observed that in FIG. 4 fins 19 also provide an additional keel surface which adds to the rotational stability of the boat. It is contemplated within the present invention that the edges of the fins need not be straight or linear but may be curved or scalloped and that the fins may deviate from the substantially triangular shape.

Although the preferred embodiment of the present invention contemplates partial recessing within the hull of a boat as shown mounting flange 32 in FIG. 1 and the installed assembly illustrated in FIG. 4, the entire assembly may be recessed completely in the hull as shown in FIG. 5. The advantage of this installation is that no fins protrude below the keel and a smooth hull is obtained free of interferring projections.

It now should be apparent that the present invention provides a channel and fin structure which may be employed in conjunction with power boats for providing the performance of an inboard boat while protecting the drive train, i.e., propeller and propeller shaft.

Although particular devices and elements have been discussed in connection with a specific embodiment of a fin assembly constructed in accordance with the technique of the present invention, others may be utilized. Furthermore, it will be understood that although an exemplary embodiment of the present invention has been disclosed and discussed, other applications and mechanical arrangements are possible and that the embodiments disclosed may be subjected to various changes, modifications and substitutions without necessarily departing from the spirit of the invention.

What is claimed is:

1. A fin structure for mounting in an opening in the hull of a power boat comprising:

An elongated rectangular panel adapted to be connected between the base edges of a pair of elongated fins, said panel having an opening therethrough adapted to receive a propeller shaft;

Each fin of said pair of fins having an unjoined leading edge, an unjoined trailing edge, and a base edge, said base edge being joined to said elongated rectangular panel to locate said pair of fins in substantially parallel alignment and to form a channel adapted to receive a propeller and the propeller shaft therein with the propeller in proximity of the trailing edges, said trailing edge of each fin having a length substantially shorter than the length of said leading edge and extending from one end of said base edge a distance greater than the most distant extremity of the propeller from said elongated rectangular panel, said leading edge extending from the end of said trailing edge and sloping forward to the other end of said base edge in a manner to maintain all points of said leading edge a greater distance from said rectangular panel than the propeller shaft received in said channel such that the propeller and propeller shaft are entirely contained within said channel formed between said pair of fins, the leading edges forming skids which protect the propeller and propeller shaft from being struck or damaged by objects greater in dimension than the spacing between said pair of fins, the slope of said leading edges offering a minimum resistance to movement through the water as well as enhancing the stability of the hull and the efficiency of the propeller; and A mounting flange external to said channel and extending along each of said pair of fins from the juncture of said base edge and said leading edge to a point on each of said fins in proximity of said trailing edge and from said point on each of said fins to said base edge and between said base edges across said rectangular panel, said flange also extending along the edge of said rectangular panel between said juncture of said base edge and said leading edge of each of said fins and the hull of the boat, said flange forming a watertight seal between said fin structure and the hull of the boat when said fin structure is inserted into a rectangular opening cut into the stern and along the keel.

2. The fin assembly described in claim 1 further including:

a pair of rudders, each in hinged engagement with one of said trailing edges of said pair of fins; and means for controlling said rudders in unison.

3. A propeller and propeller shaft housing for a power boat comprising:

A channel member having a rectangular base with substantially parallel sides, each side having a first edge of maximum height at one end of the rectangular base, the height tapering along a second edge to a minimum at the other end of said rectangular base, said rectangular base having an opening therethrough adapted to receive a bushing for a propeller shaft, said channel member being adapted to be mounted into an opening in the hull of the boat with said one end of said rectangular base and said first edge of each side being centrally located in proximity of the stern and said other end of said rectangular base being centrally located forward of said stern along the keel;

Said bushing mounted in said opening in said rectangular base and adapted to receive the propeller shaft therethrough such that said propeller shaft is centrally located between said sides;

The propeller shaft rotatably mounted through said bushing, said propeller shaft having two ends, one end thereof being centrally located between said sides in the region of said one end of said rectangular base, the other end of said propeller shaft being adapted to be coupled to a power-train;

A propeller connected to said one end of said propeller shaft; and

A mounting flange external to said channel member and extending along each of said parallel sides from said other end of said rectangular base to a point in proximity of said first edge and from said point in proximity of said first edge to a point on said rectangular base in proximity of said one end of said rectangular base and between said parallel sides across said rectangular base, said flange also extending across the other end of said rectangular base between said parallel sides, said flange forming a water-tight seal between said channel member in the hull of the boat when said channel member is inserted into the opening cut into the hull of the boat.

4. The propeller and propeller shaft housing assembly of claim 3 wherein the powertrain further includes power-train means for reversing the longitudinal direction of a rotating shaft, said power-train means having two shafts extending therefrom, one shaft being coupled to said other end of said propeller shaft and the other shaft being adapted to be connected to the drive shaft of an engine.

5. The propeller and propeller shaft housing assembly described in claim 3 further including a rudder in hinged engagement with the first edge of each of said sides.

6. The propeller and propeller shaft housing assembly described in claim 3 wherein said channel member is entirely recessed within the opening in the stern and along the keel of the boat such that no portion of said channel member extends beyond the opening.

7. The propeller and propeller shaft housing assembly described in claim 3 wherein a portion of each side extends beyond the stern opening and the keel opening to form fins for stability.

* * * * *